US009455102B2

(12) United States Patent
Takahashi et al.

(10) Patent No.: US 9,455,102 B2
(45) Date of Patent: Sep. 27, 2016

(54) KEY STRUCTURE AND ELECTRONIC APPARATUS

(71) Applicant: FUJITSU LIMITED, Kawasaki-shi, Kanagawa (JP)

(72) Inventors: Jiro Takahashi, Kawasaki (JP); Tomonori Sakurai, Kawasaki (JP); Yosui Tokuyama, Kawasaki (JP); Kazunobu Yoneyama, Kawasaki (JP)

(73) Assignee: FUJITSU LIMITED, Kawasaki (JP)

( * ) Notice: Subject to any disclaimer, the term of this patent is extended or adjusted under 35 U.S.C. 154(b) by 74 days.

(21) Appl. No.: 14/221,657

(22) Filed: Mar. 21, 2014

(65) Prior Publication Data

US 2014/0284191 A1 Sep. 25, 2014

(30) Foreign Application Priority Data

Mar. 22, 2013 (JP) ..... 2013-060639

(51) Int. Cl.
*H01H 13/06* (2006.01)

(52) U.S. Cl.
CPC ..... *H01H 13/06* (2013.01); *H01H 2223/002* (2013.01); *H01H 2229/046* (2013.01); *H01H 2229/048* (2013.01)

(58) Field of Classification Search
CPC ..... H01H 3/02; H01H 3/00; H01H 3/12; H01H 9/00; H01H 9/02; H01H 9/04; H01H 9/041; H01H 13/00; H01H 13/04; H01H 13/26; H01H 13/50; H01H 2003/02; H01H 2003/12; H01H 2223/00; H01H 2223/002; H01H 2223/01; H01H 2223/03; H01H 2223/04; H01H 2223/044; H01H 2231/00; H01H 2231/002; H01H 2231/016; H01H 2231/022; H01H 2239/034; H01H 13/02; H01H 13/06; H01H 13/70; H01H 25/00; H01H 25/04; H01H 2227/036; H01H 2215/012; H01H 2221/026
USPC ..... 200/302.2, 402, 409, 412, 520–522, 200/557, 237, 245, 252, 262, 293, 302.3, 200/308, 314, 318.1, 319, 329, 333, 341; 378/286, 287, 289, 290, 291, 316
See application file for complete search history.

(56) References Cited

U.S. PATENT DOCUMENTS

| | | | | |
|---|---|---|---|---|
| 2,451,176 | A * | 10/1948 | Schellman | 200/302.2 |
| 4,268,913 | A * | 5/1981 | Nakagiri et al. | 368/10 |
| 4,417,113 | A * | 11/1983 | Saito et al. | 200/302.2 |
| 2013/0215724 | A1* | 8/2013 | Hiranuma et al. | 368/319 |
| 2014/0233360 | A1* | 8/2014 | Koshoji et al. | 368/290 |

FOREIGN PATENT DOCUMENTS

| | | | |
|---|---|---|---|
| JP | 2004-95252 | A | 3/2004 |
| JP | 2004-146163 | A | 5/2004 |

* cited by examiner

*Primary Examiner* — Renee S Luebke
*Assistant Examiner* — Anthony R. Jimenez
(74) *Attorney, Agent, or Firm* — Westerman, Hattori, Daniels & Adrian, LLP

(57) ABSTRACT

A key structure in an electronic apparatus case includes a top portion that is exposed through a surface of the case, a shaft portion that extends from the top portion and includes a elastomer at a tip of the shaft portion, and a stopper portion that projects from a periphery of the top portion to engage and that is engaged so as to be in contact with the switch in the state where the elastomer is contracted.

15 Claims, 7 Drawing Sheets

KEY STRUCTURE AND ELECTRONIC APPARATUS

CROSS-REFERENCE TO RELATED APPLICATION

This application is based upon and claims the benefit of priority of the prior Japanese Patent Application No. 2013-060639, filed on Mar. 22, 2013, the entire contents of which are incorporated herein by reference.

FIELD

The embodiments discussed herein are related to a key structure and an electronic apparatus.

BACKGROUND

A typical key structure provided to an electronic apparatus or the like includes a water stop member, such as an O-ring or a gasket, between a shaft portion of a key and a case of the electronic apparatus to implement a waterproof function between the key and the case. In another key structure, resilience is applied to a key using a coil spring so as to bring the key back to an original position when the force that pushes down the key is released. Such techniques are discussed in, for example, Japanese Laid-open Patent Publication No. 2004-95252 or Japanese Laid-open Patent Publication No. 2004-146163.

SUMMARY

According to an aspect of the invention, a key structure in an electronic apparatus case includes a top portion that is exposed through a surface of the case, a shaft portion that extends from the top portion and includes a elastomer at a tip of the shaft portion, and a stopper portion that projects from a periphery of the top portion to engage and that is engaged so as to be in contact with the switch in the state where the elastomer is contracted.

The object and advantages of the invention will be realized and attained by means of the elements and combinations particularly pointed out in the claims.

It is to be understood that both the foregoing general description and the following detailed description are exemplary and explanatory and are not restrictive of the invention, as claimed.

DESCRIPTION OF EMBODIMENTS

Since in a typical key structure not only a key but a water stop member or a coil spring may also be used and occasionally a member for fixing the water stop member to a shaft portion of the key or a case may be additionally desired, the number of components may increase and costs may rise accordingly. In a small-sized portable terminal, such as a mobile phone or a smartphone, the key itself may be small and the assemblability may be poor, so costs may rise further.

By the way, because of the variation in size of the key or the case, the shaft portion may fail to reach a switch in the case and may move in vain even when the key is pushed down, or the shaft portion may continue to push the switch even when the key is not pushed down. In order to avoid such a vain movement of the shaft portion, it is desirable to apply pre-tension to the switch and keep the switch slightly pushed all the time.

However, when the shaft portion is made from a rigid body, the shaft portion may not be changed in shape and fine adjustment for applying suitable pre-tension to the switch may be impossible. Besides, when the shaft portion is made from a rigid body, the shaft portion lacks the ability to absorb impact, and if a fall or the like happens and impact is applied to the electronic apparatus, the impact received from the shaft portion may damage the switch.

Preferred embodiments of the key structure and the electronic apparatus are described in detail below with reference to the accompanying drawings. In the description of each embodiment below, the same references are given to similar elements and repeated explanations of such elements are omitted.

An Example of the Electronic Apparatus

Figure 1:
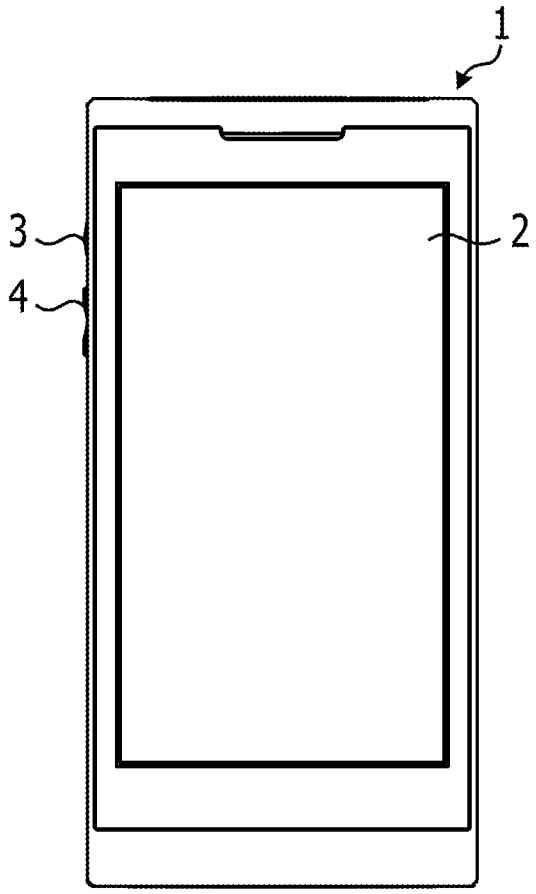
FIG. 1 illustrates an example of an electronic apparatus according to an embodiment.
Figure 2:
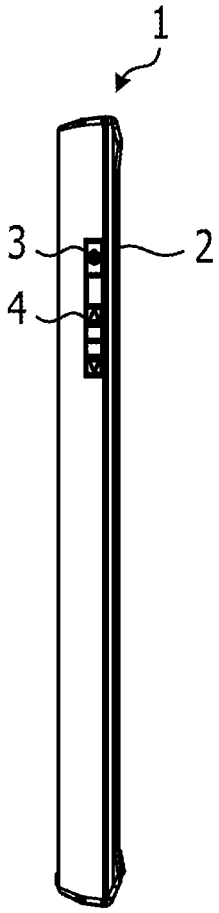
FIG. 2 illustrates the electronic apparatus in FIG. 1 viewed from the left side.

FIG. 1 illustrates an example of an electronic apparatus according to an embodiment. FIG. 2 illustrates the electronic apparatus in FIG. 1 viewed from the left side. Examples of the electronic apparatus include a portable information terminal or a radio communication terminal, such as a mobile phone, a smartphone, a tablet, or a notebook computer, and include a portable game console and a portable music player. The present embodiments are described by taking a smartphone as an example.

As illustrated in FIGS. 1 and 2, the electronic apparatus 1 includes a display panel 2 on the front side, which is provided with a touch panel for example. One of the side surfaces of the electronic apparatus 1, which is a surface on the left side in the illustrated example, is provided with, for example, a key 3 for turning on or off the power supply and a key 4 for increasing or decreasing the volume of the sound. Additionally, the electronic apparatus 1 may be provided with various other keys. Also, the electronic apparatus 1 is provided with a microphone or a speaker, which is not illustrated in the drawings.

A First Example of a Key Structure

Figure 3:
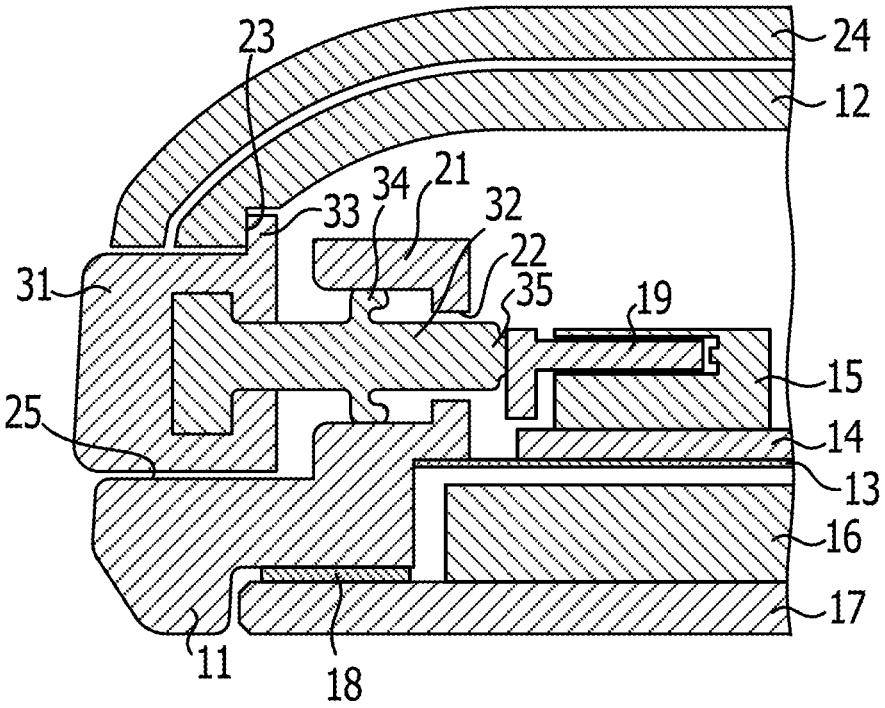
FIG. 3 illustrates first examples of a key structure and a key in the key structure according to an embodiment.

FIG. 3 illustrates first examples of a key structure and a key in the key structure according to an embodiment. As illustrated in FIG. 3, a front case 11 and a rear case 12 are combined to form a case of the electronic apparatus 1. The front case 11 covers the front side of the electronic apparatus 1. The rear case 12 covers the back side of the electronic apparatus 1. For example, each of the front case 11 and the rear case 12 may be made of resin.

The case supports the key described below so as to enable the key to advance or recede and holds a switch 15 described below inside the case. The key 3 illustrated in FIG. 2 is an example of the key in the key structure.

For example, a sheet metal portion 13, which is made of metal and shaped like a sheet, is attached to the front case 11. For example, a circuit board 14 may be attached to an inside surface of the sheet metal portion 13, that is, a surface facing the inside of the case. For example, the switch 15 is attached to an inside surface of the circuit board 14. For example, a display panel 16 and a touch panel 17 may be provided on the front side outside the sheet metal portion 13. The touch panel 17 may be attached to the front case 11 with, for example, a double-sided adhesive tape 18.

The front case 11 includes a tubular portion 21 near the switch 15. A shaft portion of the key, which is described below, is inserted into the tubular portion 21. The bottom of the tubular portion 21 faces the switch 15 and is provided with a through hole 22. The shaft portion of the key is caused to pass through the through hole 22.

An inner surface of the rear case 12 at one end is provided with a receiving portion 23. The receiving portion 23 receives a stopper portion 33 of the key, which is described below. The rear case 12 may be covered with a rear cover 24.

The key includes a top portion 31 and the shaft portion 32. The top portion 31 may be made of, for example, resin harder than elastomer. The shaft portion 32 is made of, for example, elastomer and has elasticity. The top portion 31 and the shaft portion 32 may be integrated by, for example, two-color molding or insert molding.

The top portion 31 is inserted in a through hole 25 in a side surface of the case and exposed through the side surface of the case. The top portion 31 includes the stopper portion 33. The stopper portion 33 may be integrally formed with the top portion 31. The stopper portion 33 projects from the top portion 31 in a direction substantially perpendicular to the direction in which the shaft portion 32 advances or recedes. In FIG. 3, the horizontal direction indicates the direction in which the shaft portion 32 advances or recedes, and the vertical direction indicates the direction substantially perpendicular to the direction in which the shaft portion 32 advances or recedes.

A falling-off of the key from the case may be avoided by, for example, the stopper portion 33 abutting the receiving portion 23 of the rear case 12 from the inside of the case. Furthermore, pre-tension is applied to the switch 15 as described below by, for example, the stopper portion 33 abutting the receiving portion 23 of the rear case 12 from the inside of the case. Although the stopper portion 33 projects toward the rear case 12 in the example illustrated in FIG. 3, the stopper portion 33 may project toward the front case 11 or may project toward both the front case 11 and the rear case 12.

The shaft portion 32 extends from the top portion 31 toward the switch 15. The shaft portion 32 includes a water stop portion 34. The water stop portion 34 is integrally formed with the shaft portion 32. The water stop portion 34 projects from the shaft portion 32 along the outer periphery of the shaft portion 32 in the direction substantially perpendicular to the direction in which the shaft portion 32 advances or recedes, and is in contact with an inner peripheral surface of the tubular portion 21 without space. The water stop portion 34 may be pressed against the inner peripheral surface of the tubular portion 21 and be deformed. Since the water stop portion 34 is in contact with the inner peripheral surface of the tubular portion 21, the key and the case are kept watertight between each other, and no water may be allowed to come into the case from the key portion.

The shaft portion 32 includes a small-diameter portion 35. The small-diameter portion 35 is integrally formed with the shaft portion 32. The diameter of the small-diameter portion 35 is smaller than the diameter of the shaft portion 32. The small-diameter portion 35 projects from a top end of the shaft portion 32, which is on the side of the switch 15, in the direction in which the shaft portion 32 advances. The direction in which the shaft portion 32 advances is in the direction in which the shaft portion 32 moves toward the switch 15. The direction in which the shaft portion 32 recedes is in the direction in which the shaft portion 32 moves toward the side opposite the switch 15.

The small-diameter portion 35 abuts a movable axis 19 of the switch 15, which is shaped like a stick, while the stopper portion 33 abuts the receiving portion 23 of the rear case 12 after the key has receded toward the side surface of the case. When the movable axis 19 is pushed by the shaft portion 32, the switch 15 is turned on or off for example. Returning force for the return to an initial position in a free state is applied to the movable axis 19. In the free state, no load that pushes the movable axis 19 is applied to the movable axis 19.

The diameter and the length of the small-diameter portion 35 are adjusted so that the movable axis 19 is slightly pushed from the initial position by the small-diameter portion 35 while the stopper portion 33 abuts the receiving portion 23 of the rear case 12. When the movable axis 19 is slightly pushed while the key is not pushed down, pre-tension is applied to the switch 15.

Since the small-diameter portion 35 is thinner than the shaft portion 32, the small-diameter portion 35 may be deformed more easily than the shaft portion 32 when the key is pushed down. Thus, compared with a situation in which the shaft portion 32 abuts the movable axis 19 of the switch 15 while having the diameter of the shaft portion 32, the pre-tension applied to the switch 15 may be finely adjusted more easily by adjusting the projection amount and the diameter of the small-diameter portion 35 and adjusting the deformation degree of the small-diameter portion 35. The small-diameter portion 35 may have a tapered shape that gradually increases in diameter from a top end toward the shaft portion 32.

At a trial stage, the projection amount and the diameter of the small-diameter portion 35 that may apply suitable pre-tension to the switch 15 may be decided using a trial piece of the key by repeatedly performing key operations while applying pre-tension to the switch 15 and by, for example, repeatedly sharpening the small-diameter portion 35 of the trial piece of the key little by little. Once the projection amount and the diameter of the small-diameter portion 35 are decided, a metal mold to be used for fabricating the key may be made accordingly.

Since the small-diameter portion 35 is in contact with the movable axis 19 of the switch 15, the small-diameter portion 35 directly receives the returning force of the switch 15. That is, the key directly receives the returning force of the switch 15 from the movable axis 19. Accordingly, resilience that brings the key back to the state in which the key is not pushed down is applied to the key.

The force caused by adding the returning force of the switch 15 and the pre-tension applied to the switch 15 together serves as the resilience of the key. When the water stop portion 34 of the shaft portion 32 comes into contact with the inner peripheral surface of the tubular portion 21 of the front case 11, frictional force occurs between the shaft portion 32 and the case.

Thus, in order for the key to return to the original state when the force that pushes down the key is released, it is desired that the force caused by adding the returning force of the switch 15 and the pre-tension applied to the switch 15 together be larger than the frictional force between the shaft portion 32 and the case. In the original state of the key, the stopper portion 33 of the top portion 31 abuts the receiving portion 23 of the rear case 12. In view of the above, the pre-tension applied to the switch 15 is set to be larger than the force caused by subtracting the returning force of the switch 15 from the frictional force between the shaft portion 32 and the case.

Figure 4:
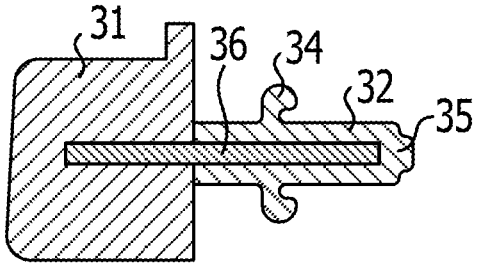
FIG. 4 illustrates a second example of the key in the key structure according to an embodiment.

FIG. 4 illustrates a second example of the key in the key structure according to an embodiment. As illustrated in FIG. 4, the key may include a core material 36 harder than elastomer in a shaft portion 32. For example, the core material 36 may be made of resin harder than elastomer or of metal, ceramics, or the like. The core material 36 has a length insufficient to reach at least a small-diameter portion 35 of the shaft portion 32. The core material 36 may be integrated with the shaft portion 32 by performing insert molding on the elastomer.

Figure 5:
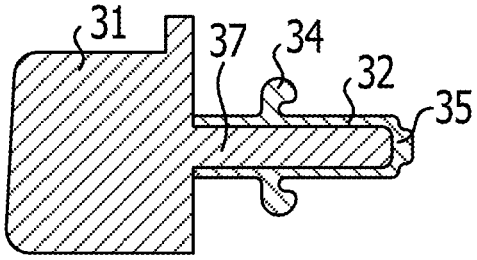
FIG. 5 illustrates a third example of the key in the key structure according to an embodiment.

FIG. 5 illustrates a third example of the key in the key structure according to an embodiment. As illustrated in FIG. 5, a core material 37 that extends from a top portion 31 and is shaped like a stick may be embedded in a shaft portion 32. The core material 37 has a length insufficient to reach at least a small-diameter portion 35 of the shaft portion 32. The core material 37 may be integrally formed with the top portion 31. The core material 37 and the shaft portion 32 may be integrated by, for example, two-color molding or insert molding.

In the key structure illustrated in FIG. 3, the water stop portion 34 is integrally provided to the shaft portion 32 of the key and the force caused by adding the returning force of the switch 15 and the pre-tension applied to the switch 15 together serves as the resilience of the key, so the number of components may be reduced. Also, because of the preferable assemblability, the number of assembling processes may be reduced. Since costs may be reduced accordingly, a low-cost key structure and an electronic apparatus that includes such a key structure may be obtained.

In the key structure illustrated in FIG. 3, suitable pre-tension may be applied to the switch 15 by adjusting the projection amount and the diameter of the small-diameter portion 35 of the shaft portion 32. Thus, when the key is pushed down, it may be possible to avoid the switch 15 moving in vain or avoid the switch 15 being kept pushed while the key is not pushed down.

In the key structure illustrated in FIG. 3, the shaft portion 32 is made of elastomer and has elasticity, so even when impact is applied to the electronic apparatus from the outside, the shaft portion 32 may absorb the impact and it may be possible to avoid the impact being applied to the switch 15. Thus, a key structure highly resistant to impact and an electronic apparatus that includes such a key structure may be obtained.

Since the use of the key illustrated in FIG. 4 or FIG. 5 limits the bending of the shaft portion 32 caused when the top portion 31 is pushed down, it may be possible to avoid the state in which the movable axis 19 of the switch 15 is unable to be pushed because of the bending of the shaft portion 32. That is, the switch 15 may be pushed as desired by pushing down the top portion 31.

A Second Example of the Key Structure

Figure 6:
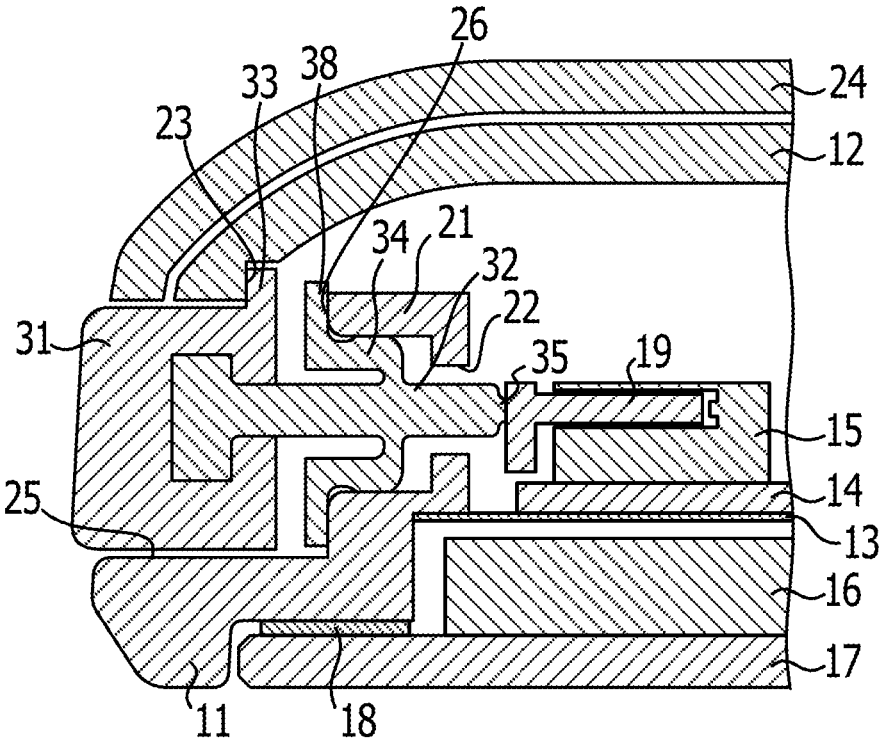
FIG. 6 illustrates a second example of the key structure according to an embodiment.

FIG. 6 illustrates a second example of the key structure according to an embodiment. As illustrated in FIG. 6, the second example of the key structure differs from the above-described first example in that a shaft portion 32 includes a flange portion 38 that extends from a water stop portion 34.

The flange portion 38 and the water stop portion 34 are integrally formed. The flange portion 38 extends from the water stop portion 34 in the direction in which the shaft portion 32 recedes, and projects in the direction substantially perpendicular to the direction in which the shaft portion 32 advances or recedes. When the key is at an original position, a surface of the flange portion 38, which is on the side of a switch 15, abuts an edge surface 26 of a tubular portion 21 of a front case 11, which is on the side facing the side surface of the case. Accordingly, drag against the advancing movement of the shaft portion 32 is applied to the key. Since the other elements are similar to the elements in the first example illustrated in FIG. 3, repeated explanations are omitted.

In the key structure illustrated in FIG. 6, the drag against the advancing movement of the shaft portion 32 is applied to the key and even when impact is applied from the outside to the electronic apparatus, the shaft portion 32 and the flange portion 38 absorb the impact, so it may be possible to avoid the impact being applied to the switch 15. Thus, a key structure highly resistant to impact and an electronic apparatus that includes such a key structure may be obtained.

A Third Example of the Key Structure

Figure 7:
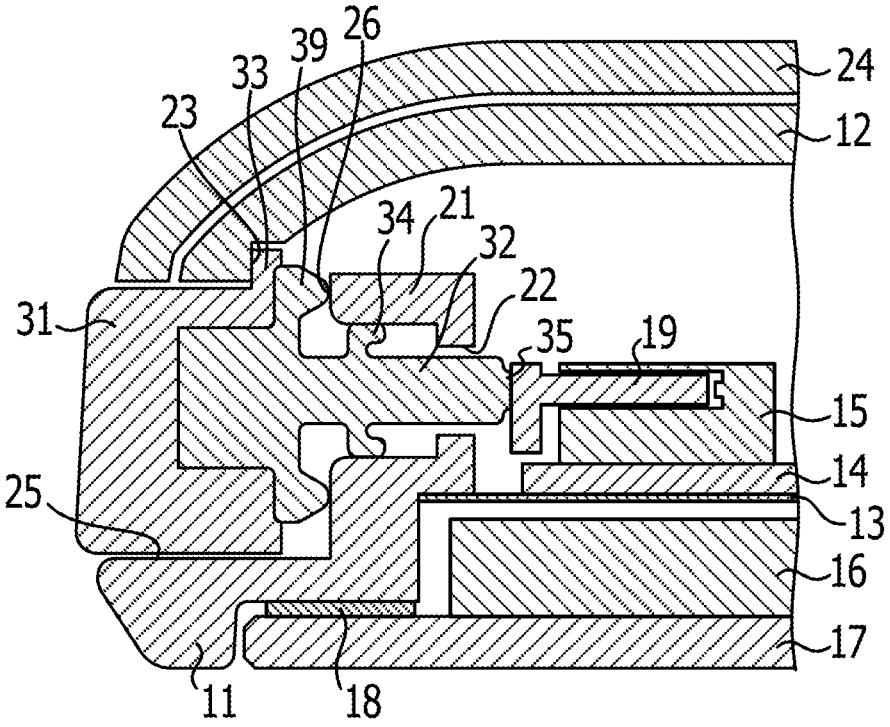
FIG. 7 illustrates a third example of the key structure according to an embodiment.

FIG. 7 illustrates a third example of the key structure according to an embodiment. As illustrated in FIG. 7, the third example of the key structure differs from the above-described first example in that a projecting portion 39 projects from a surface of a top portion 31, which faces the inside of a front case 11, in the direction in which a shaft portion 32 advances.

The projecting portion 39 may be integrally formed with the top portion 31 or the shaft portion 32. In the example illustrated in FIG. 7, the projecting portion 39 is integrally formed with the shaft portion 32. For example, the shaft portion 32 includes a flange portion 40 that projects on the side of the top portion 31, which is closer to the side surface of the case than the water stop portion 34 is, in the direction substantially perpendicular to the direction in which the shaft portion 32 advances or recedes. The projecting portion 39 projects from a surface of the flange portion of the shaft portion 32, which is on the side of a switch 15, in the direction in which the shaft portion 32 advances. When the key is in the original state, the projecting portion 39 abuts an edge surface 26 of a tubular portion 21 of the front case 11, which is on the side facing the side surface of the case.

When the key is pushed down and advances, the projecting portion 39 is deformed. Accordingly, elastic returning force occurs in the projecting portion 39. The returning force of the projecting portion 39 contributes to the resilience of the key. That is, force caused by adding the returning force of the switch 15, which occurs when the deformed projecting portion 39 returns to the original state, and pre-tension applied to the switch 15 together serves as the resilience of the key. Since the other elements are similar to the elements in the first example illustrated in FIG. 3, repeated explanations are omitted.

In the key structure illustrated in FIG. 7, the projecting portion 39 may increase the resilience of the key. Thus, even when the resilience of the key fails to become larger than the frictional force between the shaft portion 32 and the case only by adding the returning force of the switch 15 and the pre-tension applied to the switch 15 together, a sufficient amount of force as the resilience of the key may be obtained. As a result, when the force that pushes down the key is released, the key may return to the original state.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiments of the present invention have been described in detail, it should be understood that the various changes, substitutions, and alterations could be made hereto without departing from the spirit and scope of the invention.

What is claimed is:

1. A key structure in an electronic apparatus case comprising:

a top portion that is exposed through a surface of the case;

a shaft portion having a first portion which has a first width and is in contact with an inner surface of the top portion and a second portion which has a second width smaller than the first width and extends from the first portion to a switch and including an elastomer; and a stopper portion that projects from a periphery of the top portion and that engages with the shaft portion so as to be in contact with an inner surface of the electronic apparatus case in a state where the elastomer is contracted.

2. The key structure according to claim 1, wherein the top portion is made of resin harder than elastomer.

3. The key structure according to claim 1, wherein the shaft portion includes a water stop portion which extends perpendicular from the shaft portion so as to contact a tubular portion in a water tight manner.

4. The key structure according to claim 3, wherein the shaft portion includes a flange portion that extends from the water stop portion and projects in the direction perpendicular to the direction in which the shaft portion extends.

5. The key structure according to claim 1, wherein a core material harder than elastomer is included inside the shaft portion.

6. The key structure according to claim 1, wherein a core material harder than elastomer extends inside the shaft portion from the top portion.

7. The key structure according to claim 4, wherein drag against an advance of the shaft portion is applied to the key structure by contact between the flange portion and the case.

8. The key structure according to claim 1, wherein the top portion is provided so as to cover the first portion.

9. An electronic apparatus having a key structure comprising:

a case encasing a circuit board having a switch thereon;

the case includes an internal tubular portion with a through hole formed therein;

the key structure includes:

a top portion that is exposed through a surface of the case, a shaft portion having a first portion which has a first width and is in contact with an inner surface of the top portion and a second portion which has a second width smaller than the first width and extends from the first portion to a switch through the tubular portion, including an elastomer and contacting the switch, and a stopper portion that projects from a periphery of the top portion and that engages with the shaft portion so as to be in contact with an inner surface of the electronic apparatus case in a state where the elastomer is contracted.

10. The electronic apparatus according to claim 9, wherein the shaft portion extends through the tubular portion so that a small diameter portion of the shaft portion contacts a movable axis of the switch;

the shaft portion includes a water stop portion which extends perpendicular from the shaft portion so as to contact the tubular portion in a water tight manner.

11. The electronic apparatus according to claim 10, further comprising:

a flange portion that extends from the water stop portion toward the top portion and reaches outside of the tubular portion.

12. The electronic apparatus according to claim 9, further comprising:

a projecting portion that projects from an outer periphery of the top portion in the case in a direction in which the shaft portion extends.

13. The electronic apparatus according to claim 11, wherein the flange portion is configured so as to create drag on the shaft portion in a direction toward the switch.

14. The electronic apparatus according to claim 12, wherein the projecting portion abuts the tubular portion and deforms by pressure on the top portion so as to cause resilience to the top portion.

15. The electronic apparatus according to claim 9, wherein the top portion is provided so as to cover the first portion.

* * * * *